US005792005A

United States Patent [19]

Sieleman et al.

[11] Patent Number: 5,792,005

[45] Date of Patent: Aug. 11, 1998

[54] IRON GOLF CLUB HEAD

[75] Inventors: Jim Sieleman, San Diego; Richard Rugge, Encinitas, both of Calif.

[73] Assignee: Taylor Made Golf Company, Inc., Carlsbad, Calif.

[21] Appl. No.: 706,802

[22] Filed: Sep. 3, 1996

[51] Int. Cl.[6] ..... A63B 53/04

[52] U.S. Cl. ..... 473/349; 473/350

[58] Field of Search ..... 473/324, 349, 473/350

[56] References Cited

U.S. PATENT DOCUMENTS

| | | | |
|---|---|---|---|
| D. 361,813 | 8/1995 | Guibaud et al. | D21/220 |
| 4,907,806 | 3/1990 | Antonious | 273/164 |
| 4,915,386 | 4/1990 | Antonious | 473/350 |
| 4,957,294 | 9/1990 | Long | 473/350 |
| 5,356,138 | 10/1994 | Chen et al. | 273/77 A |
| 5,544,885 | 8/1996 | Besnard et al. | 473/350 |
| 5,564,705 | 10/1996 | Kobayashi | 473/334 |

FOREIGN PATENT DOCUMENTS

| | | |
|---|---|---|
| 2240935 | 8/1991 | United Kingdom . |

*Primary Examiner*—William M. Pierce
*Attorney, Agent, or Firm*—Greenblum & Bernstein, P.L.C.

[57] ABSTRACT

The invention relates to an iron golf club head including a front surface, or striking surface, and a rear surface, the striking surface and the rear surface being demarcated by an upper edge, a heel, a lower edge and a toe. The rear surface has an open cavity demarcated by a recess and a peripheral edge. The recess of the head according to the invention is a convex surface that extends from the peripheral edge of the cavity.

11 Claims, 3 Drawing Sheets

IRON GOLF CLUB HEAD

BACKGROUND OF THE INVENTION

1. Field of the Invention

The present invention relates to the field of golf clubs, and is related more particularly to the iron clubs.

Iron clubs, i.e., "irons," are generally used on a golf course to bring a ball closer to a hole after a long stroke obtained with a wood club.

The approach to the hole is easier and quicker as the is efficient. To this end, the iron head must of the iron enable a good control of the trajectory of the ball. The head must be tolerant to limit the deviations of the ball trajectory, in particular in the event the ball is struck off-centered. The head must also enable the player to really feel the contact with the ball, in order to control each stroke.

2. Background and Material Information

Quite old prior art has proposed heads having substantially tie shape of a relatively thick blade. These heads transmit good sensation to the player and make it possible work the trajectory of the ball, especially by putting a spin on the ball. On the contrary, during an off-centered stroke, the deviations of the trajectory of the ball are very substantial.

A more recent prior art has proposed heads that have a rear cavity generally located in a central area of the head, the cavity being surrounded by a thickness of material corresponding to the depth of the cavity. These heads are tolerant and limit the deviations of the trajectories of the balls. On the contrary, the head does not transmit good sensations of impact to the player. Thus the player has difficulties to work the trajectories.

The document U.S. Pat. No. 4,907,806 has proposed a head that has a rear cavity in which a mass is added at the level of the center of impact, the goal being to transmit good sensations to the player upon impact on a ball.

However, this head is not really satisfactory because the player is disturbed as soon as he strikes the ball outside of the center of impact. Indeed, the sensations perceived upon impact from the head on the ball vary considerably when the point of impact changes. In particular, the sensations become disagreeable for the off-centered strokes. The performance of the head also varies very much. If the impact occurs at the center of impact, the ball goes far afield following a good restitution effect connected to the presence of the mass in this area. On the contrary, if the impact is off-centered, the restitution phenomenon is considerably attenuated, and the ball no longer goes far afield. Moreover, for a given head mass, the quantity of material placed in the cavity is not arranged around the cavity, the effects obtained due to the cavity are therefore reduced.

The heads proposed by the prior art do not make it possible to optimize the tolerance in order to limit the deviations of the ball trajectories at the same time as the contact pith each ball in order to control the strokes.

SUMMARY OF THE INVENTION

The invention proposes a new iron head in order to remedy this disadvantage.

An iron golf club head according to the invention includes a front surface, or striking surface, and a rear surface, the striking surface and the rear surface being demarcated by an upper edge, a heel, a lower edge and a toe. The rear surface has an open cavity demarcated by a recess and a peripheral edge.

The head according to the invention includes a recess having a convex surface that extends from the peripheral edge of the cavity.

This structure gives to the striking surface a thickness that varies continuously such that the preferred striking zone, referred to as the sweet spot, provides the player with sensorial information that varies progressively between various points impact of the head on the ball. It follows advantageously that the player is not disturbed if he does not strike the ball exactly in a central portion of the sweet spot. Furthermore, the performance of the head is homogeneous. When the impact occurs at the center of impact, the ball goes far afield following a good restitution effect connected to thy presence of material in this area. So it is during off-centered impacts where the restitution effect occurs due to the progressive variation of the thickness of the striking face resulting from the shape of the recess of the cavity of the rear surface.

The head according to the invention, whose peripheral edge includes a peripheral belt integral to the rear surface, two upper and lower curved segments of the peripheral edge connecting the peripheral belt to the recess of the cavity, is have two segments that join one another at their respective ends, the lower segment being more curved than the upper segment.

The form of the segments makes it possible to distribute a portion of the head mass toward the heel and the toe, thus rendering the head more tolerant.

The form of the segments also makes it possible to arrange the head mass around the cavity preferably toward the lower edge. It follows that the trajectories of the balls are higher, making it much easier for the player to overcome the obstacle Preferably, the segments are joined so as to form two rounded portions.

It follows that the mass distribution around the cavity is progressive, which softens the behavior of the head.

Furthermore, the distance separating the recess of the cavity and the front surface is greater at the level of the lower segment than at the level of the upper segment of the peripheral edge Moreover, the width of the lower segment of the cavity is substantially constant along the length of the segment. It follows that the curvature of the cavity between the toe and the heel in the vicinity of the lower segment is similar to the curvature of the rear surface. Consequently, the head mass in this zone is distributed in a more uniform manner, which further improves the sensations perceived by the player.

The width of the upper segment of the cavity varies along the length of the segment. Preferably, the upper segment is larger at its ends than in a central zone. These characteristics also make it possible to place a little more mass toward the toe, the heel and the lower edge to improve the inertia characteristics of the head.

Finally, the lead according to the invention is the segments of the peripheral edge are substantially perpendicular to the Peripheral belt.

This arrangement facilitates the manufacturing of the head, from both metallurgical and mechanical standpoints.

BRIEF DESCRIPTION OF DRAWINGS other characteristics and advantages of the invention will be better understood by means of the description that follows, with reference to the annexed drawing illustrating, by way off a non-limiting example, how the invention can be embodied, and in which.

DETAILED DESCRIPTION OF THE PREFERRED EMBODIMENTS

Figure 1:
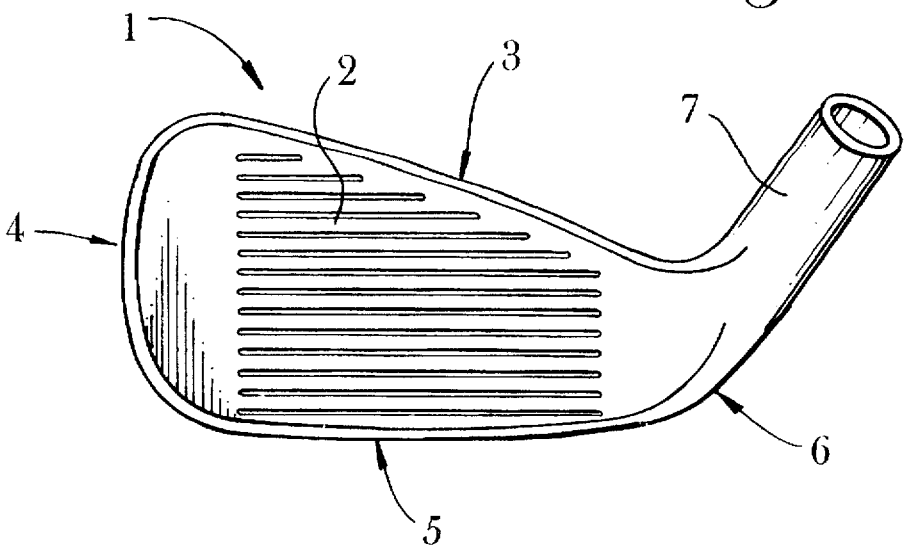
FIG. 1 shows a head according to the invention, seen from the front surface.

A golf head 1 according to the invention is shown in FIG. 1. The head 1, has a front surface or striking surface 2, surrounded by the upper edge 3, a toe 4, a lower edge 5 and a heel 6. A hosel 7 adapted to be affixed to a shaft not shown extends the head 1 or the side of the heel 6.

Figure 2:
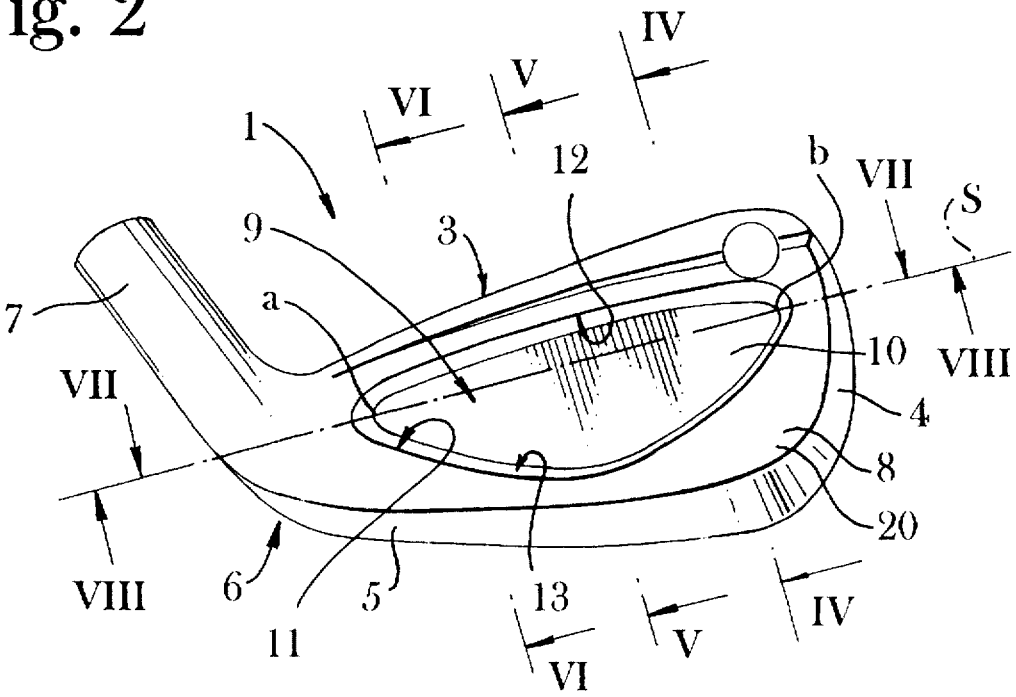
FIG. 2 shows the head seen from the rear surface.

The head 1 also includes a rear surface 8 visible in FIG. 2. As the striking surface 2, the rear surface 8 is surrounded by the upper edge 3, the toe 4, the lower edge 5 and the heel 6.

The rear surface 8 has an open cavity 9 demarcated by a recess, or recessed surface, 10 and peripheral edge 11. A peripheral wall having two segments at least partially defined by the peripheral edge 11 shape the cavity 9. An upper segment 12 extends substantially between the toe 4 and the heel 6 to demarcate the upper portion of the cavity 9. The segment 12 extends along the peripheral edge 11 between points a and b serving as a reference in the cutting plane S.

The point a is the point of the recess 10 that is the closest to the heel 6, the point b being the point of the recess 10 that is the closest to the toe 4.

Similarly a lower segment 13 extends along the peripheral edge 11 between the points a and b to demarcate the lower portion of the cavity 9.

The segments 12, 13 are each connected to the recess 10 of the cavity 9, on the one hand, and to a peripheral belt 20 of the rear surface 8 at the peripheral edge 11, the segments 12, 13 thereby having respective widths.

Each of the segments 12, 13 has a curved shape whose radius of curvature varies. Segments 12, 13 are joined at points a, b whereby the radius of curvature of the peripheral edge 11 at each of the points a, b is continuous from segment 13 and vice versa.

The upper segment 12 has a mean radius of curvature whose center is located on the side of the lower edge 5 of the head 1, whereas the lower segment 13 has a mean radius of curvature whose center is located on the side of the upper edge 5 of the head 1. Of course, each of the centers of curvature can be located closer to or further from the head 1.

However, the mean radius of curvature of the upper segment 12 is greater than the mean radius of curvature of the lower segment 13. This is why the cavity 9 does not have a symmetrical shape with respect to the plane S. It follows advantageously that a portion of the mass of the head 1 can be placed close to the lower edge 5 and the toe 4, on the one hand, and close to the lower edge 5 and the heel 6. This distribution of the mass renders the head 1 tolerant, i.e., it is stable upon impact on a ball and the lateral deviations off the trajectories of the balls are reduced. This distribution of mass also enables an improvement to the dynamic loft. Indeed the mass located toward the lower edge accentuates the deformation of the shaft by a centrifugal effect during the swing, which raises the ball higher. All occurs as if the striking surface were more inclined, than it actually is, with respect to the vertical.

The particular structure of the cavity 9, however, enables a player to really sense the contact between the ball and the striking surface 2. The shape of the cavity 9 is described by means of FIGS. 3–8.

Figure 3:
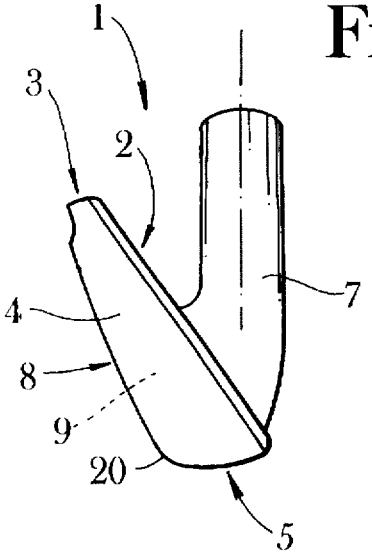
FIG. 3 is a lateral view of the head.

FIG. 3. is a lateral view of the head 1 that shows that the lower edge 5 is substantially larger than the upper edge 3.

Various cross sections of the head 1 show the change in the shape of the cavity 9 in a toe 4-heel 6 direction.

Figure 4:
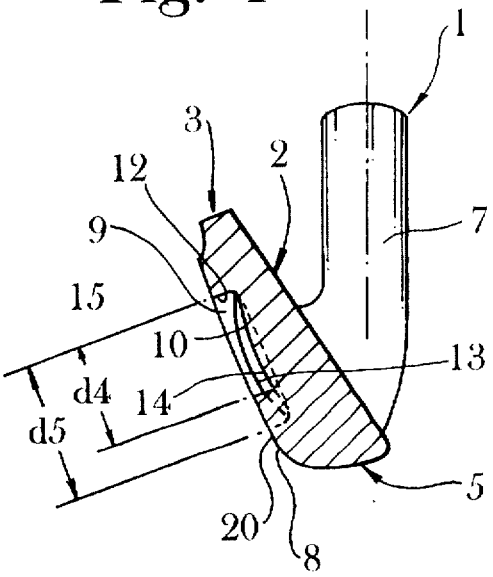
FIG. 4 is a cross-section along the line IV—IV of FIG. 2.

FIG. 4 is a cross-section of the head 1 along a plane IV—IV of FIG. 2. A distance d4 separating the upper segment 12 and the lower segment 13 of the peripheral edge 11 in the plane IV—IV is shorter than a distance d5 that corresponds to the longest distance separating the upper segment 12 and lower segment 13. The recess 10 of the cavity 9 has a convex form demarcated in the plane IV—IV by a curved line 14.

Figure 5:
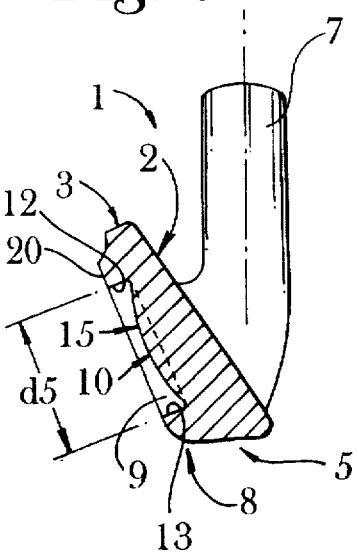
FIG. 5 is a cross-section along the line V—V of FIG. 2.

FIG. 5 is similar to FIG. 4 and corresponds to a cross section of the head 1 along a plane V—V of FIG. 2. The cross section along the plane V—V taken in a central zone of the cavity 9 where the upper segment 12 and the lower segment 13 are seperated by the distance d5. The recess 10 of the cavity 9 has a convex shape demarcated in the plane V—V by a curved line 15.

Figure 6:
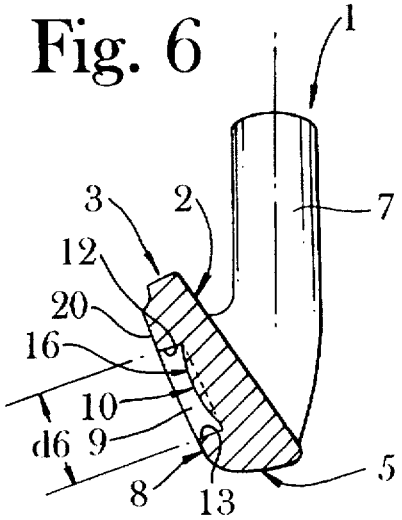
FIG. 6 is a cross-section along the line VI—VI of FIG. 2.

FIG. 6 is similar to FIGS. 4 and 5 and corrresponds to a cross-section of the head 1 along a plane VI—VI of FIG. 2 A segment 13 in the plane VI—VI is shorter than the distance d5 of the plane V—V. The recess 10 of the cavity 9 had a convex shape demarcated in the plane V—V by a curved line 16.

Of course, any other cross section of the head 1 parallel to the planes IV—IV, V—V, VI—VI would show that the recess 10 is convex between the upper segment 12 and the lower segment 13.

Figure 7:
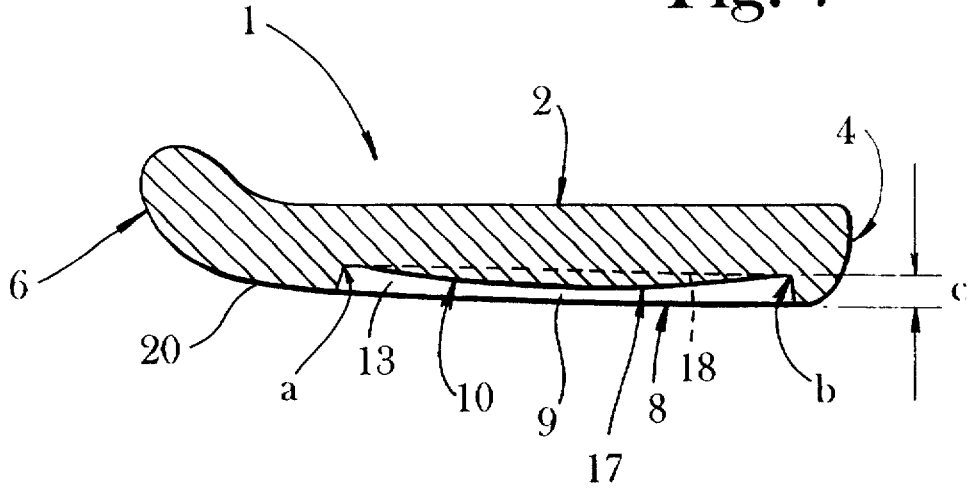
FIG. 7 is a cross-section along the line VII—VII of FIG. 2.
Figure 8:
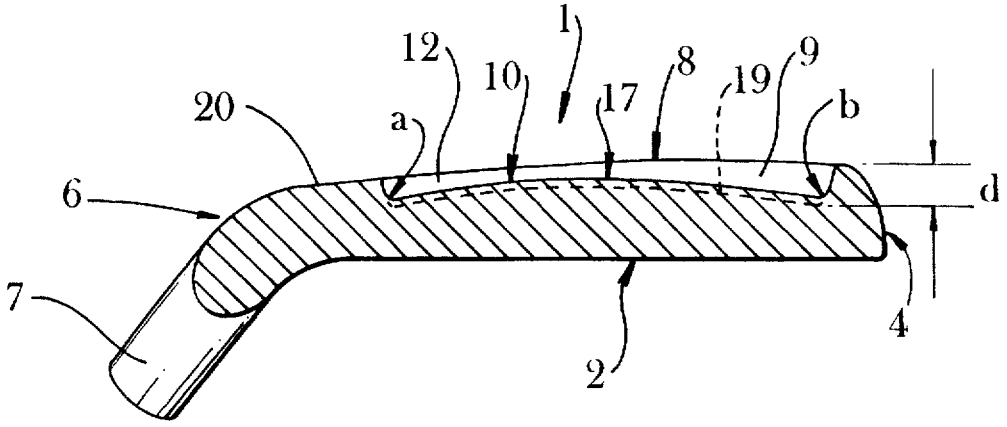
FIG. 8 is a cross-section along the line VIII—VIII of FIG. 2.

As is shown in FIGS. 7 and 8, the recess 10 of the cavity is also convex in the area 4-heel 6 direction.

FIGS. 7and 8 are cross-sections passing through the plane S between the points a and b.

FIG. 7 shows th convex shape of the recess 10 by a curved line 17 connecting the points a and b. The dotted line 18 demarcates the width C of the lower segment 13 with respect to the rear surface 8. This width leads to a substantially constant depth of the cavity 9 along the lower segment 13.

The curved line 17 is found in FIG. 8, as well as a dotted line 19 that demarcated the width d of the upper segment 12 with respect to the rear surface 8. This width leads to a variable depth of the cavity 9 along the upper segment 12, the segment 12 being larger toward its ends, close to the points a and b, than in a central zone between the points a and b. This arrangement makes it possible to remove a portion of the mass of the head 1 that would be located in the cavity 9, close to the upper segment 12, at the level of the points a and b, to place it toward the lower edge 5.

The segments 12 and 13 of the peripheral edge 11 are substantially perpendicular to the peripheral belt 20.

As has been noted in FIGS. 4–8, the recess as 10 of the cavity 9 is convex; the recess 10 includes a single peak oriented toward the ear surface 8. According to the preferred embodiment shown in the drawings, the recess 10 consists of a single smooth contour delimited by the junction between the surface and the peripheral wall defined by the upper and lower segments 12, 13. Also according to a preferred embodiment, the peripheral wall consists of a single smooth continuous surface bounding the rear surface 10.

FIGS. 4–6 show that a distance separating the recess of the cavity 9 and the front surface 2 is greater at the level of the lower segment 13 than at the level of the upper segment 12 of the peripheral edge 11, regardless of the cutting plane parallel to one of the planes IV—IV, V—V or VI—VI. Consequently, the mass distribution occurs further toward the lower edge 5 of the head 1 and provides it with a better behavior, especially with respect to the sensation perceived by the player.

Surprisingly, the previously described shape of the cavity 9 with the recess 10 enables both a good distribution of the mass of the head 1 and a good perception, by the player, of the contact of the striking surface 2 on a ball.

The head 1 can be made from various metals or metal alloys, by any technique known to one skilled in the art, such as molding, forging, drawing, machining, electroerosion, or the like. However, the head 1 is preferably manufactured by casting in a steel alloy ceramic mold.

Of course, the invention is not limited to the embodiment thus described, and it comprises all of the technical equivalents within the scope of the claims that follow.

In particular, slight variations can be provided in the shape of the cavity 9, whether for the upper segment 12, the lower segment 13 or each of the convex lines passing through a cutting plane of the head 1. An essential feature is that the recess 10 is convex, in any plane cutting the peripheral edge 11, between the two intersections of the cutting plane and of the peripheral edge 11. Stated another way, in any transverse plane extending through the recessed surface 10, a cross-section of the recessed surface defines a convex line extending between a pair of spaced points defined by the junction between the peripheral wall 11 and the recessed surface 10. This relationship is shown, e.g., in FIGS. 4–8.

It can be provided that the distribution of the mass of the head 1 vary slightly from one head to another in a set of irons, but that each head have a convex cavity recess 10.

What is claimed is:

1. An iron golf club head comprising:

a front surface and a rear surface, said front surface and said rear surface being demarcated by an upper edge, a lower edge, a heel, and a toe;

said rear surface including a peripheral belt and an open cavity, said open cavity being defined by a recessed surface surrounded by said peripheral belt, said rear surface further including a peripheral wall extending between said recessed surface and said peripheral belt, said peripheral wall and said peripheral belt being connected at a peripheral edge;

said peripheral wall extending from said peripheral edge to a junction at said recessed surface, said peripheral wall comprising an upper curved segment and a lower curved segment; and said recessed surface having a shape extending convexly in both horizontal and vertical directions from said junction between said peripheral wall and said recessed surface inwardly away from said junction, wherein, in any transverse plane extending through said recessed surface, a cross-section of said recessed surface defines a convex line extending between a pair of spaced points defined by said junction between said peripheral wall and said recessed surface.

2. An iron golf club head according to claim 1, wherein:

said upper curved segment and said lower curved segment of said peripheral wall have respective ends joined to thereby constitute said peripheral wall, said lower curved segment being more greatly curved than said upper curved segment.

3. An iron golf club head according to claim 2, wherein:

at each of said respective ends at which said upper curved segment and said lower curved segment are joined said peripheral wall is defined by a continuous radius of curvature.

4. An iron golf club head according to claim 2, wherein:

said recessed surface is spaced from said front surface, at said junction between said recessed surface and said peripheral wall at said lower segment, by a distance greater than said recessed surface is spaced from said front surface, at said junction between said recessed surface and said peripheral wall at said upper segment.

5. An iron golf club head according to claim 2, wherein:

said lower segment of said peripheral wall has a substantially constant width.

6. An iron golf club head according to claim 2, wherein:

said upper segment of said peripheral wall has a variable width along a length of said upper segment.

7. An iron golf club head according to claim 6, wherein:

said upper segment comprises a central zone and an end on opposite sides of said central zone;

said width of said upper segment is greater at said ends than at said central zone.

8. An iron golf club head according to claim 2, wherein:

said peripheral wall is substantially perpendicular to said peripheral belt.

9. An iron golf club head according to claim 2, wherein:

said recessed surface comprises a single peak extending rearwardly.

10. An iron golf club head according to claim 2, wherein:

said recessed surface consists of a single smooth convex contour.

11. An iron golf club head according to claim 10, wherein:

said peripheral wall consists of a single smooth surface.

* * * * *